US009791141B2

(12) United States Patent
Creusen et al.

(10) Patent No.: US 9,791,141 B2
(45) Date of Patent: Oct. 17, 2017

(54) LIGHT EMITTING DIODE MODULE

(71) Applicant: PHILIPS LIGHTING HOLDING B.V., Eindhoven (NL)

(72) Inventors: Martinus Petrus Creusen, Wijlre (NL); Jan De Graaf, Uden (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/786,738

(22) PCT Filed: Apr. 21, 2014

(86) PCT No.: PCT/EP2014/058030

§ 371 (c)(1),
(2) Date: Oct. 23, 2015

(87) PCT Pub. No.: WO2014/173850

PCT Pub. Date: Oct. 30, 2014

(65) Prior Publication Data

US 2016/0076754 A1 Mar. 17, 2016

(30) Foreign Application Priority Data

Apr. 25, 2013 (EP) ..... 13165373

(51) Int. Cl.
*F21K 99/00* (2016.01)
*F21V 29/73* (2015.01)
(Continued)

(52) U.S. Cl.
CPC ..... *F21V 29/73* (2015.01); *F21K 9/00* (2013.01); *F21K 9/64* (2016.08); *F21V 17/12* (2013.01); *F21V 29/502* (2015.01); *F21V 29/505* (2015.01); *F21V 29/713* (2015.01); *F21Y 2115/10* (2016.08)

(58) Field of Classification Search
CPC ..... F21V 29/73; F21V 29/502; F21V 29/505; F21V 29/713; F21V 9/00
See application file for complete search history.

(56) References Cited

U.S. PATENT DOCUMENTS 8,425,065 B2 * 4/2013 Ravillisetty ..... C09K 11/0883 362/249.02
2011/0019409 A1 1/2011 Wronski
(Continued)

FOREIGN PATENT DOCUMENTS

CN 201748246 U 2/2011
CN 201753870 U 3/2011
(Continued)

*Primary Examiner* — Anabel Ton

(57) ABSTRACT

The present application relates to a light emitting diode module comprising: a light source device (11), a cover (10) for said light source device (11), the cover (10) being arranged to connect to an optical device (21); wherein said cover (10) comprises a heat conducting part (24, 34) which has an at least one order of magnitude higher thermal conductivity than the remaining part of the cover (10) and which is arranged to thermally connect said light source device (11) with said optical device (21). The present application further relates to a corresponding cover for a light source device (11) in a light emitting diode module (1).

14 Claims, 3 Drawing Sheets

(51) Int. Cl.

| | |
|---|---|
| ***F21K 9/00*** | (2016.01) |
| ***F21V 17/12*** | (2006.01) |
| ***F21V 29/505*** | (2015.01) |
| ***F21V 29/502*** | (2015.01) |
| ***F21V 29/71*** | (2015.01) |
| ***F21K 9/64*** | (2016.01) |
| *F21Y 115/10* | (2016.01) |

(56) References Cited

U.S. PATENT DOCUMENTS

| | | | |
|---|---|---|---|
| 2012/0069547 | A1 | 3/2012 | Gielen et al. |
| 2013/0009179 | A1 | 1/2013 | Bhat et al. |
| 2013/0088876 | A1 | 4/2013 | Harbers et al. |

FOREIGN PATENT DOCUMENTS

| | | | |
|---|---|---|---|
| EP | 2124255 | A1 | 11/2009 |
| EP | 2604912 | A1 | 6/2013 |
| EP | 2738457 | A1 | 6/2014 |
| JP | 2009071254 | A | 4/2009 |
| KR | 20120039225 | A | 4/2012 |
| KR | 20120088941 | A | 8/2012 |
| WO | 2011117775 | A1 | 9/2011 |
| WO | 2011139538 | A1 | 11/2011 |
| WO | 2012020646 | A1 | 2/2012 |
| WO | 2012124186 | A1 | 9/2012 |
| WO | 2013013514 | A1 | 1/2013 |

* cited by examiner

LIGHT EMITTING DIODE MODULE

CROSS-REFERENCE TO PRIOR APPLICATIONS

This application is the U.S. National Phase application under 35 U.S.C. §371 of International Application No. PCT/EP2014/058030, filed on Apr. 21, 2014, which claims the benefit of European Patent Application No. 13165373.5, filed on Apr. 25, 2013. These applications are hereby incorporated by reference herein.

FIELD OF THE INVENTION

The present invention relates to a lighting device, and in particular to an improved light emitting diode module.

BACKGROUND OF THE INVENTION

Light emitting diode (LED) modules, such as in the form of a spot module, is one of many lighting device types which are available today. LED modules typically comprises a light source device, such as one or more LED packages, a chip on board (COB) module or a printed circuit board (PCB) with discrete LED packages, and a cover for the light source device. The cover is provided for e.g. protecting the light source device, providing a mechanical reference surface, and/or connection of a reflector thereto.

The light source device may further comprise a phosphor element, in some cases remotely arranged, for modifying the light provided by the LEDs. For example, white light may be achieved by LEDs providing blue light which passes through a phosphor element, where some of the light is converted into yellow light. Thus, the output light comprising blue and yellow components gives an overall white impression. The phosphor element is typically provided on top of the LED part of the light source device. In some configurations, the phosphor element may instead be provided as a phosphor disk arranged at a distance from the LED part of the light source device.

The cover is typically made of a plastic material with a relatively low thermal conductivity and not suitable to be used as heat conductor, and adapted to be arranged over the light source device but still let through the light provided by the light source(s). The cover may e.g. comprise a centered aperture to be arranged over the light source(s) of the light source device.

An optical device, such as a reflector, a collimator or a lens, is typically connected to the LED module for providing e.g. focusing of the provided light in a specific direction. A reflector base of a reflector may for example be arranged in a recessed area of the cover.

The light source device generates heat, both from the LED part and the phosphor element (if included). It is desirable to remove as much of the generated heat as possible in order to not overheat the LED module. For the LED part of the light source device, overheating may result in a lower efficacy and a reduced lifetime of the LEDs. For the phosphor element, overheating may result in quenching effect leading to poor light conversion efficiency. In order to lead away heat, LED modules are connected to a heat sink which is mounted to a backside of the LED module. The heat sink is arranged adjacent to a part of the light source device, such that heat generated by the light source device is dissipated via the backside of the light source device to the ambient via the heat sink.

In order to increase the dissipation area, the optical device in the form of a reflector may be arranged to connect to the remote phosphor element directly. Thus, heat generated by the phosphor element may be dissipated to the ambient via the outer surface of the reflector. Alternatively, the heat sink may be made larger in order to increase its heat dissipation efficiency. However, these solutions require modifications of the design for the LED module, the heat sink and/or the optical device. Also, when making the heat sink larger, the total size of the combination of the LED module and heat sink is increased, which counteracts the typical ambition to keep the construction small.

Thus, there is a need for a LED module with an improved heat removal without the above mentioned drawbacks.

SUMMARY OF THE INVENTION

It is an object of the present invention to overcome this problem, and to provide an improved LED module in view of the heat dissipating function, in particular of heat generated by the light source device. Another object of the present invention is to provide a solution to the problem while maintaining the possibility to design a LED module which is small and which may comply with a specific standard, for example the Zhaga standard.

According to a first aspect of the invention, this and other objects are achieved by a LED module comprising: a light source device, a cover for the light source device, the cover being arranged to connect to an optical device, wherein the cover comprises a heat conducting part which has an at least one order of magnitude higher thermal conductivity than the remaining part of the cover and which is arranged to thermally connect the light source device with the optical device.

Thus an optical device attached to the LED module is utilized as a heat dissipating member. The optical device may be e.g. a reflector, a collimator, or a lens.

A cover according to the prior art is normally made of a material with a relatively low thermal conductivity which is as such not suitable to be used for heat conduction and efficient heat removal. By providing a heat conducting part to the cover, the LED module does not need any significant modifications in order to benefit from the increase in heat removal which is enabled by the heat conducting part of the cover. The heat conducting part thermally connects one or more parts of the light source device to the optical device, such that an additional heat conduction path is provided, in view of known solutions where a heat sink is provided for heat dissipation.

The heat conductive part of the cover has an at least one order of magnitude, for example a factor of 10, higher thermal conductivity than the thermal conductivity of the remaining part of the cover. In other words, the heat conductive part of the cover is suitable to be used for heat conduction and efficient heat removal, whereas the remaining part of the cover, which has a relatively low thermal conductivity, is not suitable to be used for heat conduction and efficient heat removal. In embodiments the thermal conductivity of the heat conductive part of the cover is at least two orders of magnitude, for example a factor of 100, higher than the thermal conductivity of the remaining part of the cover.

Because of the integration of the heat conduction part as a portion or as a separate part in the cover enabling the conduction of heat to the heat dissipating optical device, the LED modules increases its heat removal efficiency without the need for a larger heat sink. Thus, the heat removal efficiency may be increased without the need for increasing the size of the LED module together with the heat sink.

Further, the heat conducting part may be integrated in the cover without changing the dimensions of the cover. Thus, the cover and LED module may still comply with any standard according to which the LED module is designed. An example of such a standard is the Zhaga standard, which includes definitions of maximum height and width of the cover.

The light source device may comprise, for example, a LED chip or one or more LED packages arranged on a printed circuit board (PCB). The light source device may further comprise a phosphor element, which may be remotely arranged. The heat conducting part may be arranged to thermally connect the LED chip or one or more LED elements and/or the phosphor element with the optical device.

In an embodiment where the light source device comprises a remote phosphor element, the phosphor element may be arranged between the heat conducting part and the cover, such that the phosphor element is fixated. The heat conducting part may thus be utilized as a mounting means for the phosphor element. The phosphor element may be added to the LED module in a late stage configuration. In such a configuration, the heat conducting part, forming a separable part of the cover, is then also added to the LED module.

The LED module may comprise heat conducting fastening means to fasten the cover to a heat sink. The heat conducting part may be arranged to thermally connect the light source device with the heat sink via the fastening means. Thus, the heat conducting part provides, besides the additional heat conducting path to the optical device, also an enhanced heat conducting path between the light source device and the heat sink. The fastening means may for example comprise screws or bayonet coupling means, and is preferably of a metal, thermally conductive plastics, a thermally conductive ceramic, or the like, for providing a good thermal conductivity.

The heat conducting part may be arranged to surround the heat conducting fastening means. The heat conducting part may be made of a material with heat conducting properties that are comparable to the heat conducting properties as the material of the heat conducting fastening means, such as for example metal. In such an embodiment creep may be alleviated which is a common problem when the fastening means is mounted in plastic materials.

According to a second aspect of the invention, the above mentioned and other objects are achieved by a cover for a light source device in a light emitting diode module, the cover being arranged to connect to an optical device, wherein the cover comprises a heat conducting part arranged to thermally connect the light source device with the optical device.

The above mentioned features, when applicable, apply to this second aspect as well. In order to avoid undue repetition, reference is made to the above.

It is noted that the invention relates to all possible combinations of features recited in the claims.

BRIEF DESCRIPTION OF THE DRAWINGS

This and other aspects of the present invention will now be described in more detail, with reference to the appended drawings showing embodiments of the invention.

As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein. Rather, these embodiments are provided for thoroughness and completeness, and fully convey the scope of the invention to the skilled person.

Figure 1:
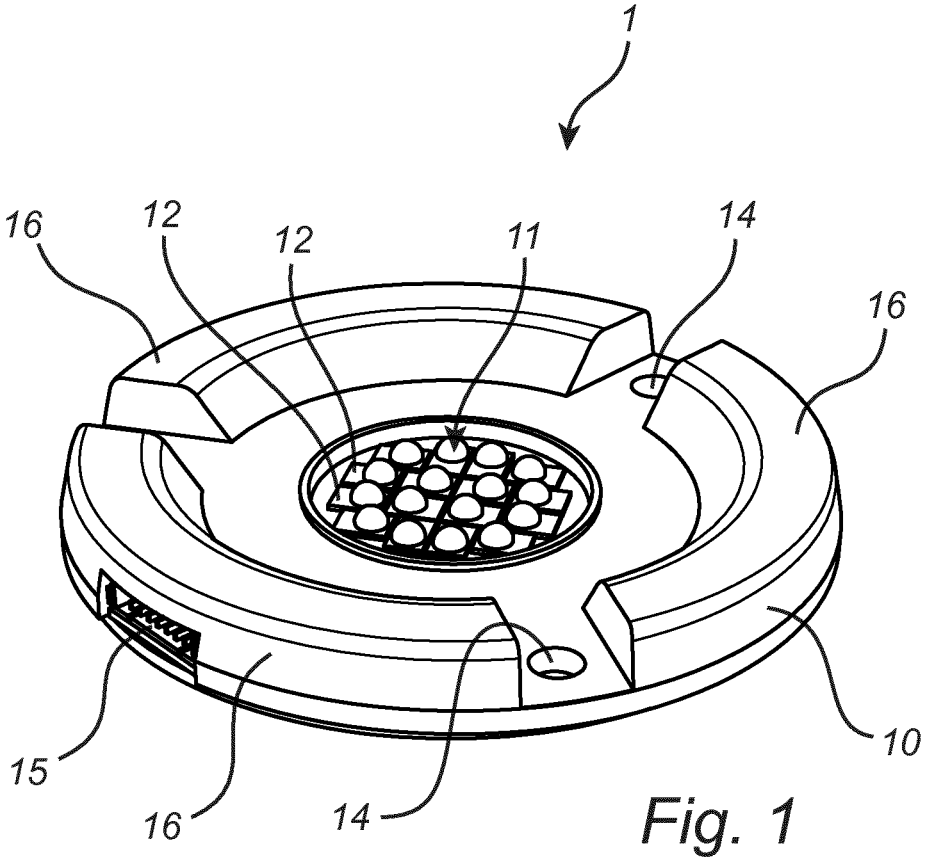
FIG. 1 illustrates a general structure of a light emitting diode module.

A basic design of a light emitting diode (LED) module 1, in the form of a spot module, is illustrated in FIG. 1. The LED module 1 comprises a cover 10 and a light source device 11. The light source device 11 comprises in this embodiment a plurality of LED packages 12. The LED packages 12 may be may be arranged on a printed circuit board (PCB).

A conventional cover of this type is typically made of a material which has a relatively low thermal conductivity and which is therefore not suitable to efficiently conduct heat, such as for example plastics. However, the cover 10 may, as will become clear, according to the present invention comprise one or more parts of other materials, in particular heat conducting materials, which have a relatively high thermal conductivity as compared to the conventional cover material. The thermal conductivity of the heat conducting material is at least one order of magnitude higher, for example a factor of 10, or, in other embodiments, at least two orders of magnitude higher, for example a factor of 100, than the thermal conductivity of the material of the conventional cover.

The cover 10 is arranged on a light source device 11. The cover 10 comprises a central aperture in which the light source device 11 is located when the cover 10 is arranged on the light source device 11. The cover 10 thus protects the light source device 11 from the surrounding and vice versa, while still letting through light, provided by the light source device, by means of the central aperture. The cover 10 also functions as a housing for both the light source device 11 and for any further components. For example, the LED module 1 is in FIG. 1 provided with connection means 15, for connecting an electronic control gear to the light source device 11.

The cover 10 is provided with edge portions 16 such that a central recess is formed. The edge portions 16 are adapted for connecting to an optical device, in this example in the form of a reflector. In this case, the edge portions 16 are arranged to receive a reflector base of a reflector. In FIG. 1, the edge portions 16 have inclined inner surfaces for receiving a reflector base of a hemispherical design.

The cover 10 is thus arranged to connect to a reflector base. The design of the cover 10 for achieving the connecting feature may vary between different constructions. An optical device in the form of e.g. a reflector may for example connect to a peripheral side of the cover 10, instead of to an upper portion as in the disclosed example above. In that case, the optical device is arranged to surround the cover 10.

Typically, the cover 10 is arranged to connect a particular type of optical device having a standardized design.

The cover 10 is provided with mounting holes 14. By the mounting holes 14, the cover 10 may be mounted to a heat sink, which will now be disclosed with reference to FIG. 2.

Figure 2:
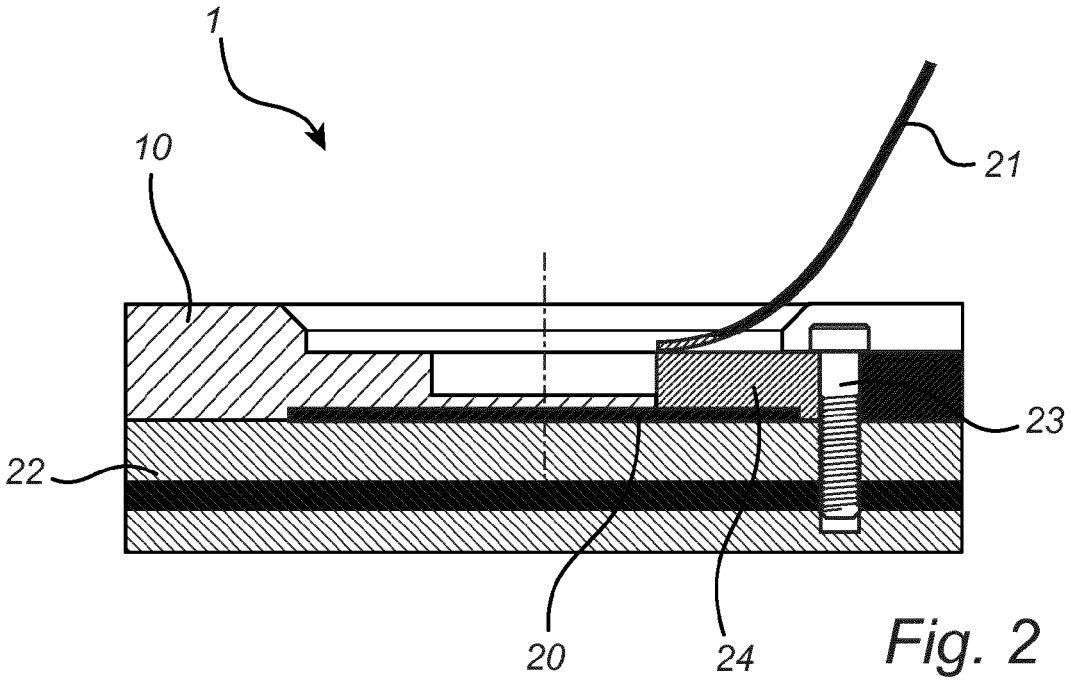
FIGS. 2 and 3 are cross-sectional views of light emitting diode modules according to different embodiments of the present invention.

FIG. 2 is a cross-sectional view of one embodiment of a LED module 1, according to the present invention. A heat sink 22 is provided on and facing a backside of the cover 10 and the light source device, which in this embodiment is provided in the form of a LED chip 20. In other embodiments, the light source device may be provided in another form, such as a printed circuit board (PCB) with one or more discrete LEDs.

In other embodiments, the LED chip 20, or similar light source device element, may have a different extension and even extend outside the cover 10 and LED module 1.

The heat sink 22 is provided for dissipating heat generated by the LED chip 20. The cover 10 is mounted on the heat sink 22 by one or more fastening means in the form of screws 23. The screws 23 are made of a heat conducting material, such as metal, thermally conductive plastics or a thermally conductive ceramic.

The screw 23 is in this figure only visible on the right side of the figure, due to the non-opposing positioning of the mounting holes corresponding to the mounting holes 14 of FIG. 1. However, LED module 1 may comprise further screws. The number of mounting holes may vary between different embodiments.

In an alternative embodiment, the one or more fastening means may be replaced, partly or in full, with a one-time fixation between the cover 10 and the heat sink 22. The cover 10 and the heat sink 22 may in such an embodiment be one-time fixated by means of e.g. press-fitting or gluing.

In an alternative embodiment, a layer of a heat conducting material may be provided between the light source device and the heat sink 22 for improving the heat conduction between these elements. For example, a layer of a heat conducting material may be provided between the LED chip 20 and the heat sink 22.

The LED chip 20 provides light through a central aperture in the cover 10, as previously disclosed. It is appreciated that the light source device may comprise further elements, or be formed of alternative elements, such as one or more LED packages arranged on a printed circuit board (PCB).

The cover 10 is connected to a base of an optical device in the form of a reflector 21, by receiving the base in a central recess of the cover 10. As disclosed above, the optical device may be arranged differently, for example by connecting to a peripheral edge portion of the cover 10.

The cover 10 comprises a heat conducting part 24 and the remaining part of the cover 10 is made of a material which has a relatively low thermal conductivity and which is not suitable to be used as heat conductor or as efficient thermal connector, for example the thermal conductivity of the remaining part of the cover 10 is one order of magnitude lower than the thermal conductivity of the heat conducting part 24 of the cover 10. The heat conducting part 24 is arranged such that it thermally connects the LED chip 20 to the reflector base. By the heat conducting part 24 of the cover 10 an additional heat conducting path is arranged in the LED module 1. The additional heat conducting path is provided in addition to the heat conducting path between the LED chip 20 and the heat sink 22.

The heat conducting part 24 is further arranged such that it connects the LED chip 20 to the heat conducting screw 23. The screw 23 transports the heat from the heat conducting part 24 to the heat sink 22. By this connection, the heat conducting path between the LED chip 20 and the heat sink is enhanced.

The heat conducting part 24 is in this embodiment provided as a portion of the cover 10. The heat conducting part 24 is made of a metal having a good and relatively high heat conductivity.

Thus, the cover 10 is in this embodiment a material hybrid cover comprising a heat conducting material and a material not suitable for heat conduction, for example metal and plastic. An upper portion of the cover 10, which is accessible during use, is made in thermally non-conductive plastics or another material having a low thermal conductivity. This feature alleviates the burn risk if coming into contact with this portion.

In another embodiment, the heat conducting part 24 may be made in a thermally conductive plastics or a thermally conductive ceramic. Thus, the cover 10 is in such an embodiment a material hybrid cover of thermally conductive plastics and plastics with a relative low thermal conductivity not being suitable for heat conduction, for example a thermal conductivity which is one order of magnitude lower or even two orders of magnitude lower than the thermal conductivity of the heat conducting part 24, or of a thermally conductive ceramic and plastics with a relative low thermal conductivity not being suitable for heat conduction, for example a thermal conductivity which is one order of magnitude lower or even two orders of magnitude lower than the thermal conductivity of the heat conducting part 24.

Figure 3:
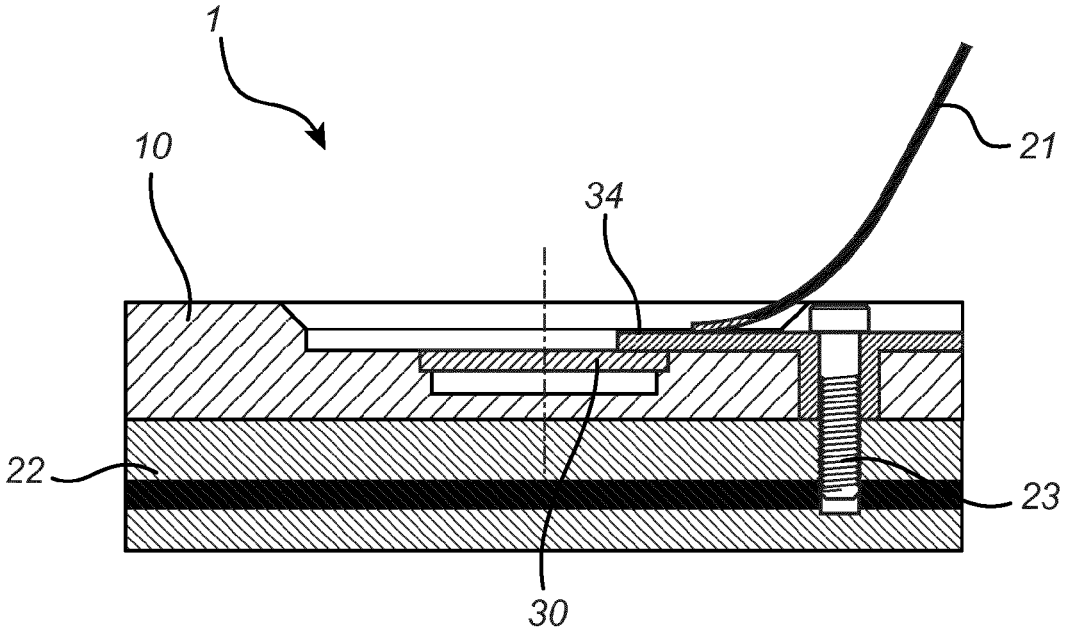

FIG. 3 illustrates another embodiment of a LED module 1 according to the present invention. The LED module 1 comprises a cover 10 and is connected to a heat sink 22 as previously disclosed. The cover 10 is affixed to the heat sink 22 by means of heat conducting screws 23. The cover 10 is, as previously disclosed, arranged to receive an optical device in the form of a reflector 21. In this embodiment, the light source device comprises a phosphor element 30. It is appreciated that the light source device may comprise further elements, such as LED chip or one or more LED packages. Such elements are not illustrated in FIG. 3, but the skilled person is well acquainted with how to add such elements in construction.

The phosphor element 30 is provided for altering the characteristics of the light output from the LED module 1, by converting through-passing light. For example, a phosphor element 30 adapted to convert through-passing into yellow light may be used in combination with a light source device 11 generating blue light in order to provide white output light. The white output light is formed by a combination of blue light emitted from the light source device and yellow light emitted from the phosphor element 30, using some of the blue light as an excitation source.

The phosphor element 30 is in this embodiment provided as a remote phosphor element, meaning that the phosphor element 30 is arranged separately, i.e. not in direct connection, to some or all other parts of the light source device, such as a LED chip or a PCB comprising one or more discrete LED packages. When the phosphor element 30 is arranged in a remote manner, the conventional heat conducting path from the phosphor element 30 to the heat sink 22 is relatively weak, in comparison to the heat conducting path between the LED chip 20 of FIG. 2, which is arranged in close connection to the heat sink 22. Since the remote phosphor element 30 generates heat, there is a risk of overheating when the remote phosphor element is arranged in a conventional LED module with a conventional cover.

Overheating of the phosphor element 30 leads to phosphor quenching effects, which results in a poor light conversion efficiency.

However, according to the present invention, an additional heat conducting path is provided by a heat conducting part 34. In this embodiment, the heat conducting part 34 forms a portion of the cover 10, meaning that the heat conducting part 34 is a separable part of the cover 10. The heat conducting part 34 is arranged such that it thermally connects the phosphor element 30 with the reflector base of the reflector 21.

The heat conducting part 34 may be formed as a metal ring which is adapted to be arranged in the central recess of the cover 10.

As for previously disclosed embodiments, the heat conducting part 34 is made of a material with a relatively high thermal conductivity, such as a metal.

The heat conducting part 34 is further arranged to extend to one or more of the heat conducting screws 23. The phosphor element 30 is thus not only thermally connected to the reflector base of the reflector 21, but also to the heat sink 22 via the heat conducting screws 23. Thus, the heat dissipation capacity in view of heat generated by the phosphor element 30 is increased.

The heat conducting part 34 is also arranged such that it surrounds the screw 23. The cover 10 may be provided with mounting holes in which the heat conducting part 34 is arranged to slide into when arranged on the cover 10. In such an embodiment, the holes for the screws 23 are partly or in whole formed in the heat conducting part 34.

Conventionally, the screws 23 are arranged in mounting holes in a plastic portion of the cover. This type of mounting may result in reliability problems as a result of creep. However, by mounting screws 23 in a heat conducting part 34 both of which are made of a comparable heat conducting material, these creep effects may be alleviated. For example, mounting screws 23 made of metal in a heat conducting part 34 made of metal may alleviate the creep effects.

Thus, the heat conducting part 34 provides an additional heat conducting path between the phosphor element 30 and the optical device, in the form of the reflector 21, as well as an enhancement of the heat conducting path between the phosphor element 30 and the heat sink 22. Additionally, in one embodiment the heat conducting part 34 may be provided such that creep due to mounting of the screws 23 in plastic portions is alleviated by mounting the screws 23, made of metal, in the heat conducting part 34, also made of metal, instead.

The phosphor element 30 is arranged in the cover such that a lower surface of the phosphor element 30 faces a portion of the cover 10 and an upper surface faces away from the cover 10. An edge portion of the lower surface of the phosphor element 30 is arranged in connection to a lower portion of the cover 10. The heat conducting part 34 is arranged in connection to an edge portion of the upper surface of the remote phosphor element 30. Thus, the phosphor element 30 is fixated between the lower portion of the cover 10 and the heat conducting part 34, also being a part of the cover 10. The heat conducting part 34 thus functions as a mounting means for the phosphor element 30, which both fixates the phosphor element 30 to the LED module 1 and provides a heat dissipating function for heat generated in the phosphor element 30.

The heat conducting part 34, being a separable part of the cover 10, may be added to the LED module 1 as a part of a late stage configuration of the LED module 1. In such a configuration, for configuring e.g. correlated color temperature (CCT) or color rendering index (CRI), a phosphor element is arranged on the cover 10. Subsequently, the heat conducting part 34 is arranged on the cover 10, thereby forming a part of the cover 10, and in connection to the upper surface of the phosphor element 30. Thus, an edge portion of the phosphor element 30 is fixated by being sandwiched between a lower portion of the cover 10 and an upper portion of the cover 10, i.e. the heat conducting part 34.

Figure 4:
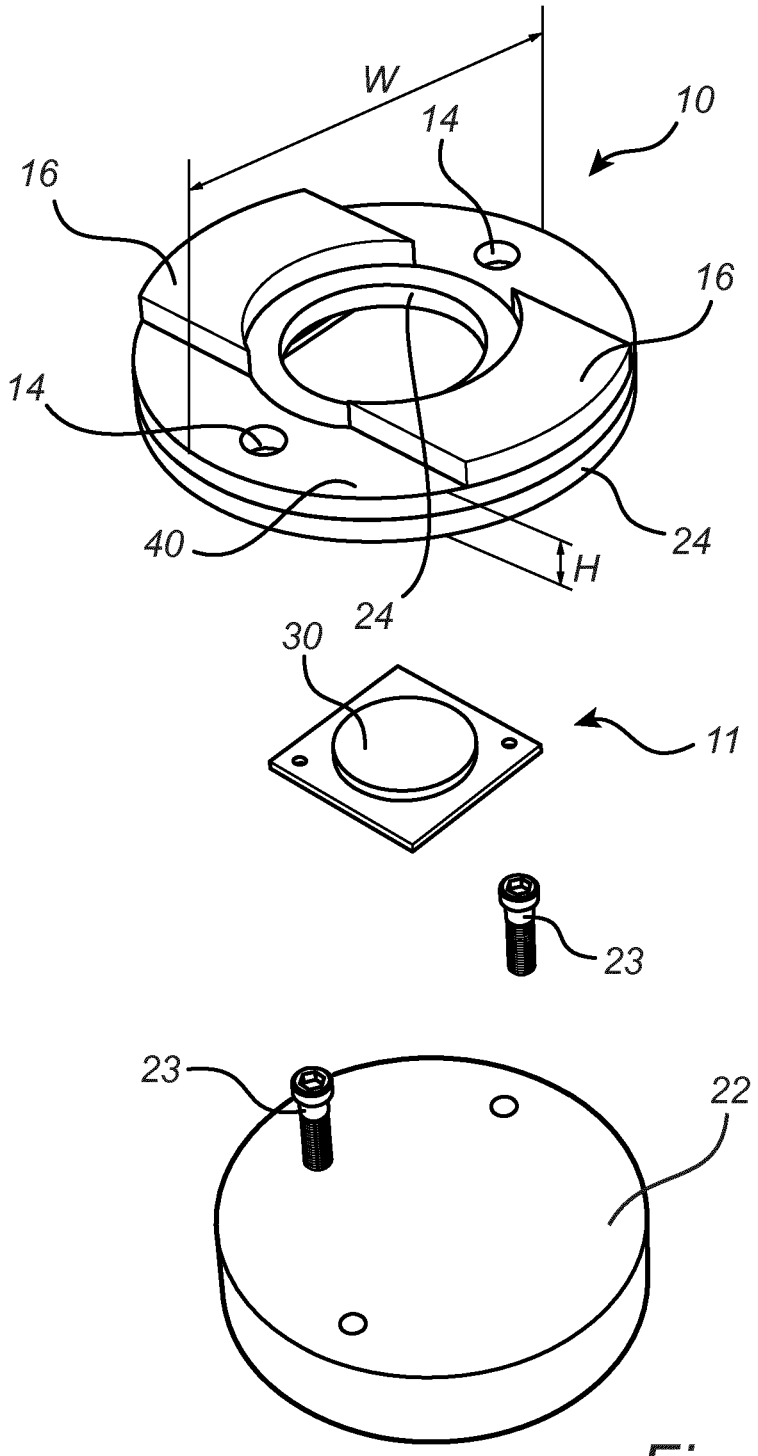
FIG. 4 is an exploded view of a light emitting diode module according to an embodiment of the present invention.

FIG. 4 illustrates another embodiment of a LED module according to the present invention. As previously disclosed, the LED module comprises a cover 10, a light source device 11, and heat conducting fastening means in the form of screws 23 for affixing the cover 10 to a heat sink 22. The cover 10 comprises an upper portion 40, which is made of a material with a relatively low thermal conductivity not suitable to be used as heat conductor, and a lower portion being a heat conducting part 24 as previously disclosed in connection to FIG. 2. The heat conducting part 24 forms a portion of the cover 10, i.e. is the upper portion 40 and the heat conducting part 24 form a composite unit. The heat conducting part 24 has a different shape in this embodiment when compared to the embodiment of FIG. 2, however the function remains the same.

The light source device 11 comprises a phosphor element 30, as previously disclosed. The phosphor element 30 is arranged on one or more discrete LED packages (not shown) arranged on a printed circuit board (PCB).

The LED module is assembled by arranging the light source device 11 on the heat sink 22, providing the cover 10 on the heat sink 22 and on the light source device 11, and fixating the cover 10 to the heat sink 22 by means of the screws 23. The light source device 11 is thus fixated between the cover 10 and the heat sink 22. Optionally, the light source device 11 may be affixed to the heat sink by means of additional fastening means.

The cover 10 is arranged with edge portions 16. The edge portions 16 provide a central recess of the cover 10 in which an optical device in the form of a reflector (not shown) may be arranged. The heat conducting part 24 provides a heat dissipating function as disclosed in connection to FIG. 2, i.e. between the light source device 11 and a reflector base of the reflector. The heat conducting part 24 further provides an enhanced heat dissipating path between the light source device 11 and the heat sink 22 via the screws 23. The edge portions 16 of the cover 10 are for example made of a material with a relatively low thermal conductivity not suitable for efficient heat conduction.

In this embodiment, the heat dissipating part 24 provides a heat dissipating path between all parts of the light source device 11, i.e. both the phosphor element 30 and the one or more light emitting elements. In other embodiments, the heat conducting part (being a portion or a separate part of the cover 10) may be arranged to provide a heat dissipating path to only a part of the light source device 11, which, as previously disclosed, may comprise remote parts.

Since the heat conducting part according to the embodiments of the inventions forms a portion or a part of the cover 10 without necessarily affecting the dimensions of the cover 10, the heat conducting part may be a part of a standardized sized cover 10. One widely used standard is the Zhaga standard, which defines the dimension of the cover 10 in view of its height H and width W. Thus, a cover 10 complying with the Zhaga standard, or any other similarly defined standard, may still comply with this standard when equipped with a heat conducting part according to the present invention.

For complying with the Zhaga standard, the cover 10 has a maximum width W of 50 millimeters, and a maximum height H of 7.2 millimeters.

The person skilled in the art realizes that the present invention by no means is limited to the preferred embodiments described above. On the contrary, many modifications and variations are possible within the scope of the appended claims. For example, the heat conducting part may have many different forms while still fulfilling its purpose of providing an additional heat conducting paths. Non-limiting examples of such forms are provided by the description above, and it is appreciated by the skilled person how to modify the constructions while keeping the effect. The heat conducting part may further be provided in differently constructed LED modules, not necessarily following any specific standard. It is also appreciated that the light source device may be of different forms and may comprise other or additional elements than the non-limiting examples disclosed above. Moreover, the fastening means are not limited to screws, instead the fastening means may be, for example, bayonet coupling means.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A light emitting diode module, comprising:

a light source device;

a cover for said light source device, the cover being arranged to connect to an optical device arranged to receive light from the light source device;

wherein said cover comprises a heat conducting part which has an at least one order of magnitude higher thermal conductivity than the remaining part of the cover and which is arranged to thermally connect said light source device with said optical device; and wherein said light source device comprises a remote phosphor element, and wherein said heat conducting part is arranged to thermally connect said remote phosphor element with said optical device, said heat conducting part arranged between and directly contacting said remote phosphor element and a base of said optical device.

2. The light emitting diode module according to claim 1, wherein said heat conducting part forms a portion of said cover.

3. The light emitting diode module according to claim 1, wherein said heat conducting part is a separable part of said cover.

4. The light emitting diode module according to claim 1, wherein said light source device comprises a light emitting diode chip or a printed circuit board with one or more light emitting diodes, and wherein said heat conducting part is arranged to thermally connect said light emitting diode chip or said printed circuit board with one or more light emitting diodes with said optical device.

5. The light emitting diode module according to claim 1, wherein said remote phosphor element is arranged between said heat conducting part and said cover, such that the phosphor element is fixated.

6. The light emitting diode module according to claim 1, further comprising heat conducting fastening means for fastening said cover to a heat sink, wherein the heat conducting part is arranged to thermally connect said light source device with said heat sink via said fastening means.

7. The light emitting diode module according to claim 6, wherein said fastening means is chosen from a group comprising: screws and bayonet coupling means.

8. The light emitting diode module according to claim 6, wherein said heat conducting part surrounds said heat conducting fastening means.

9. The light emitting diode module according to claim 1, wherein said heat conducting part comprises a metal, thermally conductive plastics or a thermally conductive ceramic.

10. A cover for a light source device in a light emitting diode module according to claim 1, the cover being arranged to connect to an optical device, wherein said cover comprises a heat conducting part which has an at least one order of magnitude higher thermal conductivity than the remaining part of the cover and which is arranged to thermally connect said light source device with said optical device.

11. The cover according to claim 10, further comprising a mounting hole for connecting said cover to a heat sink via heat conducting fastening means, wherein said heat conducting part is arranged to thermally connect said light source device with said heat sink via said fastening means.

12. The cover according to claim 11, wherein said heat conducting part surrounds said mounting hole.

13. The cover according to claim 11, wherein said optical device is one of the following: reflector, collimator, and lens.

14. The cover according to claim 10, wherein said cover has a maximum width of 50 mm, and a maximum height of 7.2 mm.

* * * * *